United States Patent [19]

Moncrieff-Yeates

[11] 4,061,189

[45] Dec. 6, 1977

[54] VORTICAL FLOWAEROTHERMODYNAMIC HEAT EXCHANGER

[76] Inventor: Alexander J. Moncrieff-Yeates, 8609 Hillside Place, Fairfax, Va. 22030

[21] Appl. No.: 727,703

[22] Filed: Sept. 29, 1976

Related U.S. Application Data

[62] Division of Ser. No. 570,798, April 23, 1975.

[51] Int. Cl.[2] ..... F28F 3/12

[52] U.S. Cl. ..... 165/168; 126/121; 126/131

[58] Field of Search ..... 126/120, 121, 130, 131, 126/140; 165/168, 169

[56] References Cited

U.S. PATENT DOCUMENTS

| | | | |
|---|---|---|---|
| 53,880 | 4/1866 | Rogers | 126/121 |
| 142,241 | 8/1873 | Kepler | 126/131 |
| 241,720 | 5/1881 | Ricketts | 126/130 |
| 1,526,541 | 2/1925 | Groth | 126/121 |
| 1,714,955 | 5/1929 | Helms | 126/121 |
| 1,952,281 | 3/1934 | Ranque | 62/170 |
| 2,185,788 | 1/1940 | Fredlund | 126/121 |
| 2,586,002 | 2/1952 | Carson, Jr. et al. | 62/136 |
| 2,642,859 | 6/1953 | Brown | 126/121 |
| 2,705,488 | 4/1955 | Wright | 126/121 |
| 2,821,975 | 2/1958 | Thulman | 126/120 |
| 3,007,310 | 11/1961 | Eisele | 60/69.69 |
| 3,030,773 | 4/1962 | Johnson | 60/69.65 |
| 3,096,754 | 7/1963 | Howrey | 126/120 |
| 3,118,489 | 1/1964 | Anthes | 431/158 |
| 3,255,802 | 6/1966 | Browning | 431/4 |
| 3,258,052 | 6/1968 | Wilson et al. | 431/158 |
| 3,372,689 | 3/1968 | Goudy | 126/140 |
| 3,896,785 | 7/1975 | Nelson | 126/121 |

FOREIGN PATENT DOCUMENTS

| | | | |
|---|---|---|---|
| 675,375 | 2/1930 | France | 126/120 |

*Primary Examiner*—Ronald C. Capossela

*Attorney, Agent, or Firm*—Sixbey, Bradford & Leedom

[57] ABSTRACT

A heat exchanger particularly for use in a circulating hot air fireplace is constructed to induce vorticity in the flame and/or hot combustion gases at a position in proximity to a heat exchange surface to enhance residence time and thermal transfer to the circulating air.

The vorticity pattern acts as a self-adjusting flow controller.

22 Claims, 3 Drawing Figures

Fig. 1
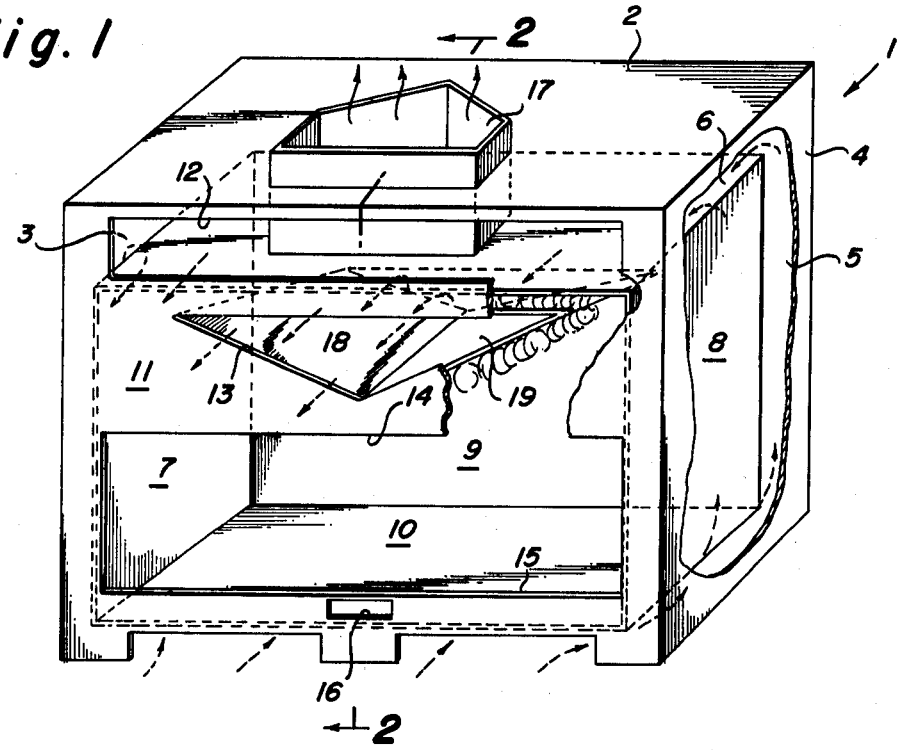
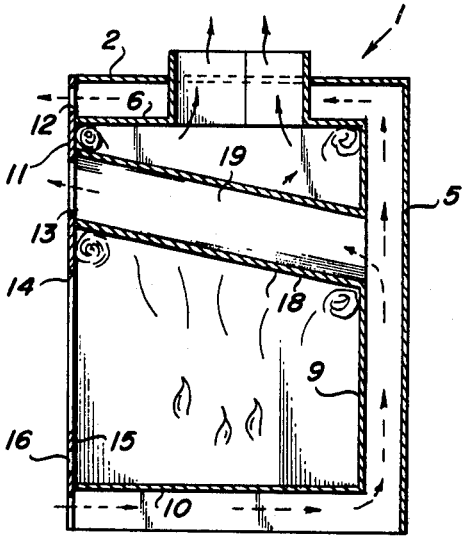
Fig. 2
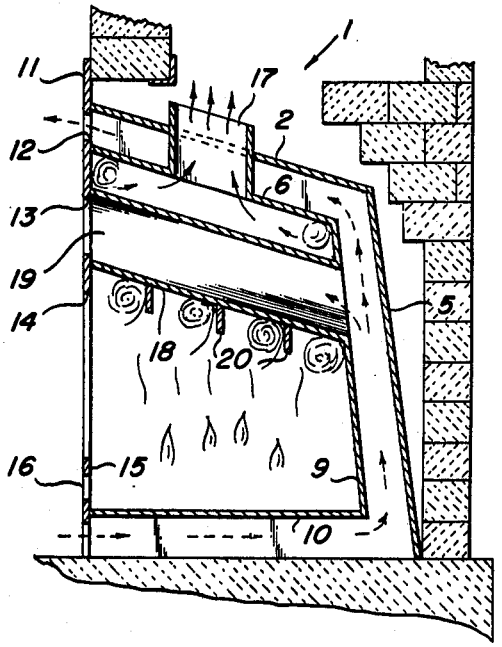
Fig. 3

VORTICAL FLOWAEROTHERMODYNAMIC HEAT EXCHANGER

This application is a division of my copending application Ser. No. 570,798, filed Apr. 23, 1975.

FIELD OF INVENTION

This invention relates generally to heat exchangers, and is particularly applicable to furnaces and fireplace units wherein room air is circulated, either by convection or by mechanical forcing means, in heat exchange relationship to a combustion chamber and returned to the room in heated condition. While described in its preferred embodiment in a fireplace, the invention is also applicable to any heat exchange structure wherein heat is to be extracted from a flowing hot gaseous source.

BACKGROUND OF INVENTION — PRIOR ART

Considering first the prior art relating to air circulating fire places, it is known to construct fireplaces or inserts therefor which provide means to circulate room air through passages in the walls defining the combustion chamber to absorb heat from the source, after which the heated air is returned to the room. This art includes elaborate labyrinthian passages for the room air and combustion air alike in an attempt to lengthen the period of residence of the respective flows in mutual heat exchange relationship, as exemplified by U.S. Pat. No. 2,642,859, issued June 23, 1953 to Newman T. Brown. Moreover, it has been proposed to so dimension the combustion chamber that an unconfined slowly descending recirculating flow of combustion air is encouraged, as seen in U.S. Pat. No. 773,863, issued Nov. 1, 1804 to Mary F. Frecktling, and to provide confined passages to direct a recirculating flow, as in U.S. Pat. No. 2,821,975, issued Feb. 4, 1958 to Robert K. Thulman, in U.S. Pat. No. 2,185,788, issued Jan. 2, 1940 to August R. Fredlund, and in U.S. Pat. No. 53,880, issued Apr. 10, 1866 to Francis M. Rogers. It is noted that the Frecktling disclosure recirculates only the slowly moving portion of the combustion products, the principle heat containing portion passing directly to the flue. On the other hand, the other disclosures in which substantial portions of the combustion flow are recirculated in confined paths requires the introduction of structural impedance to the gas flow and depends upon the presence of a large expanse of heat exchange surface.

Turning to the art relating to combustion generally, it is well known to induce a helical flow of a fuel/air mixture in order to increase the residence time of the mixture within the combustion zone and thus enhance complete combustion, and it has been suggested that such an effort may be augmented by restricting the outlet of the combustion chamber or by introducing a supplemental forced air flow. For an example of this art, reference is to U.S. Pat. No. 3,007,310, issued Nov. 7, 1961 to Karl Eisele and to U.S. Pat. No. 3,258,052 issued June 28, 1966 to Alfred Wilson, et al. Augmentation of the spiral flow of air/fuel mixture has also been proposed by flow conditions which induce an annular tore comprising a flame vortex adjacent the base of the flame in U.S. Pat. No. 3,030,773, issued Apr. 24, 1962 to Robert H. Johnson and in U.S. Pat. No. 3,255,802 issued June 14, 1966 to James A. Browning. A similar flow is induced within the area of air/fuel mixing in U.S. Pat. No. 3,118,489, issued Jan. 21, 1964 to Clifford C. Anthes.

Considering the prior art even more generally, in the field of heat exchange it is known to induce a gaseous medium to flow in a vortical pattern extending axially of a tubular conduit in order to increase residence time, enhance scrubbing action and to obtain an interchange of position of the molecules of high velocity and temperature gases from the center of the vortex with the outer molecules which have been deprived of their energy and velocity through functional heat exchange contact with the vortex tube in which the vortical flow is confined. This is exemplified by the well known "Ranque" tube (U.S. Pat. No. 1,952,281, Mar. 27, 1934) and see U.S. Pat. No. 2,586,002, issued Feb. 19, 1952 to W. R. Carson, Jr. et al.

In summary, the prior art is known to disclose inducement of vortical flow in precombustion gases and basal portions of flame patterns for the purpose of enhancing the mixing of the fuel air mixture, and the prior art discloses inducement of hot gas vorticity axially of confined conduits of heat exchangers.

OBJECTS OF INVENTION

In contradistinction of the foregoing, it is among the objects of this invention to provide an aerothermodynamic heat exchange structure including features which:

1. a stable, relatively unconfined flow of hot gases is induced and maintained throughout varying conditions of temperature and velocity,
2. the hot gas vorticity is established proximate to a heat exchange surface at which hot gas residence time is prolonged, thus enhancing heat exchange,
3. the vortex axis of the hot gas is perpendicular to the hot gas flow entering and exiting the vortex area whereby the vortex fluid impedance varies with variations in hot gas velocity,
4. a vortical hot gas flow pattern is maintained in a heat exchanger which presents minimal structural impedance to gas flow,
5. a hot gas flow path is maintained free of areas of aerodynamic stagnation,
6. the area of heat exchange surface is minimized,
7. the area of frictional contact of flowing gases with flow conduits is maximized, and
8. a self-regulating draft is established by vortex imposed aerodynamic impedance.

DESCRIPTION OF DRAWINGS

The aforestated objects, as well as other objects inherent in the apparatus of this invention will be apparent from a consideration of the ensueing specification and reference to the drawings, in which:

FIG. 1 is a perspective view of a fireplace unit having portions of the front end and one side broken away to reveal interior features in cross section, FIG. 2 is a elevational cross section taken through line 2 — 2 of FIG. 1, FIG. 3 is a view similar to that of FIG. 2 of an alternative embodiment.

TERMINOLOGY

This invention relates to the phenomena of heat exchange between a heated high velocity gas induced to flow in a relatively confined vortical pattern in close proximity to a heat exchange surface through which heat is transmitted to a relatively cooler fluid. In order to maintain a distinction between the aforementioned prior art in which vortical patterns are produced at basal portions of a flame for the purpose of enhancing combustion, this specification will refer to the heated gas as the donative gas and to the cooler fluid as the recipient. Thus, donative gas is that gas which has been brought to a temperature condition where it is ready to be introduced into the heat exchange relationship and may include portions of the flame in which combustion is sufficiently complete to have brought about the aforesaid temperature condition, as well as combustion products immediately downstream of a flame, or gas heated at a remote point. Recipient fluid, on the other hand, is any fluid, i.e., liquid or gas, which received heat from the donative gas.

DESCRIPTION OF INVENTION

Referring first to FIGS. 1–3, there are depicted fireplace units, each comprising an outer enclosure generally designated 1 and including a top wall 2, side walls 3 and 4, and a back wall 5. Spaced inwardly from said outer enclosure walls is a fire enclosure defined by a top wall 6, side walls 7, 8, a back wall 9, and a bottom 10. Both enclosures share a common partial front wall 11 extending downwardly from the top wall 2 and defining a plurality of openings, namely an upper recipient gas exit at 12, a lower recipient gas exit at 13, and a fire enclosure opening at 14. A barrier lip 15 on the front wall which is immediately superjacent to the fire enclosure bottom 10 for purposes to be elaborated on in the ensueing specification, includes one or more openings 16 to provide the entrance of combustion air. These openings may be provided with appropriate flow control valves (not shown) to provide controllable draft. A combustion gas exhaust passage for communicating the fire enclosure with a flue is defined by a duct 17. FIG. 3 discloses a alternative embodiment configured so as to be particularly adaptable to existing fireplaces, and wherein the backs 5, 9 and top 2 are sloped.

A still further alternative (not shown) would eliminate the outer enclosure and utilize the existing fireplace enclosure in lieu thereof.

In FIGS. 1–3 the path of the room air through the unit, wherein it is termed recipient air to denote its function of reception of heat for conveyance to the room area by convection, is traced by dashed line arrows, whereas the path of heated combustion products, termed donative gas, is denoted by solid line arrows. In the latter regard, particular attention is invited to the path of the donative gases (which may include the flame under some conditions and/or the intensely heated gases downstream of the flame under other conditions) by which they are brought in contact with the undersurface 18 of a duct 19 interconnecting the recipient air passage through an opening in rear combustion chamber wall 9 with the recipient duct exit 13. The undersurface forms a flame plate whereby, at the points of juncture of this flame plate duct 19 with the partial front wall and with the rear wall, the donative gas flow is induced to flow in a pattern of vorticity which remains stable throughout a wide range of temperature and velocity. Again, after leaving the aforementioned vorticies, the combustion gases encounter the juncture of the back and front walls 9 and 11 with the flame enclosure top wall 6, vortical flow patterns are again established and maintained in a stable persistent pattern throughout varying flow conditions. In the present model, four front vortices exist under all tested operating conditions and four additional (rear) vortices arise when the fire extends sufficiently rearwardly in the flame enclosure. Additional vortices may be induced by the provision of lateral fins 20 (FIG. 3) to the underside of the flame plate surface 18. These fins serve to augment the stabilization of the aforementioned vortices and to establish additional vortices either independently under high velocity conditions, or as the original stable vortex increases in translational velocity and in circumference to a point where it overflows the partial barrier formed by the fin and adopts a vortical flow pattern in the adjacent channel defined by the flame plate 18 and the fins 20.

While depicted in FIGS. 1–3 as a complete insert unit, it is readily apparent that the essence of this invention is equally applicable to an insert which utilizes an existing fireplace as the flame enclosure, and wherein the insert includes only the flow diverting flame plate, and the vortex defining juncture is formed of additional flow diverting elements extending from a juncture with the flame plate toward the flame.

In each instance, the stable vortical patterns of donative gas flow are established by structure which presents a partial barrier (i.e. the underside 18 of the flame plate duct 19 and the top of the flame enclosure) to the otherwise free unobstructed flow of hot donative gas toward the flue while permitting the flue to draw off gases from the end of the vortex so formed. The latter function is enhanced by slanting the barrier in its longitudinal direction upwardly in the direction of gas flow so that the long axis of the vortex coincides with the predominent direction of ultimate gas flow and thus leads toward the flue opening.

In addition to the aforementioned longitudinal slant of the flame plate 19, it is desirable to provide a pitch in a direction transverse to the slant direction, thus to establish an axial flow within the vorticity pattern. To this end, the flame plate 19 should have a transverse pitch of approximately 15 degrees, the pitch being transverse to the slant and directed upwardly to a free edge, which edge coacts with a contiguous area of the enclosure wall 8 to define a portion of the donative gas flow path therebetween. In the preferred embodiment wherein the flame plate 19 extends through the center of the enclosure, thus dividing the enclosure into two donative gas flow portions, the flame plate diverges laterally outwardly from a longitudinal central portion of the plate to terminate at two free edges defining the two flow path portions.

A preferred size prescribes a horizontal minor dimension of 22 inches, a vertical minor dimension of 3 inches, and a divergent pitch of 15° in the flame plate surface. This pitch is established at 0.5 to 2 times the slant angle of flame plate duct 19 from the rear wall 9 to the partial front wall 11. The aim is to present a partial barrier to the upward donative gas flow, thus causing the gas to arrive at the aforementioned junctures and form vortices commencing at the low point (center portion) of flame plate 19 and extending upwardly in each lateral direction to terminate at a free edge of said flame plate spaced from a contiguous portion of the enclosure wall 8.

The cross sectional pitch configuration and longitudinal slant of the duct also has certain beneficial effects on the flow therethrough of recipient gases. First, the combination of upward pitch from rear to front and from center to sides tends to encourage lateral flow patterns within the flame plate duct 19 by virtue of the increased tendency of the heated recipient gas to lift off a sloped surface. Thus, slowly spiralling counterrotating recipient gas currents occuring at respective sides of the center line of the duct disrupt otherwise lamellar flow patterns, whereby to assist in the suspectibility of the recipient gas to heat exchange. Secondly, a preferred embodiment enhances this circulation by providing sufficient heights above the extreme lateral extent of the flame plate 18 for the lift off of recipient gas to occur, tending toward an equalization of flow through the duct 19 at its center and at its sides. The sides should be limited in height as shown inasmuch as they are not in proximity to the vortices of the donative gas and hence are relatively ineffective as heat transfer surfaces.

The sum of the areas of the two recipient gas exits 12 and 13 with respect to the area of the bottom air inlet should be such that the mass flow of the inlet gas at room temperature approximates the sum of the mass flows of the recipient gas at the respective temperatures of exit, which have been found typically to be 200° F at exit 12 and 300° F at exit 13.

In a model dimensioned as set forth stable vorticies are maintained at rotational speeds of approxmiately 100 rotations/second in a vortex of 4 inches diameter while the longitudinal velocity is about 2 feet/second. Since, in this example, heat transfer surface is present around half of that circumference, an effective exchange surface path over a one foot segment of the distance from fire to flue is $$(100 \times \pi \times 4)/(12 \times 2) = 50 \text{ feet}$$

Where the heat exchange surface surrounds more than half of the vortex, the denominator is correspondingly decreased. Since each vortex is 2 feet long, the effective scrubbing or heat exchange surface is $50 \times 2 = 100$ square feet, whereas the volumne of each vortex is $$(\pi \times 4^2 \times 2)/(144 \times 4) = 1/6 \text{ cubic feet}$$

The vortices tend to decrease the effective size of the donor gas conduit to the flue by expanding into the open area of the flue, or stated conversely, tend to increase the aerodynamic impedance. Empirical design can achieve a self adjusting system wherein the effective flue impedance is least when the convection is least and increases as convection increases. This mechanism is not fully understood, but appears to depend upon the matching of aerodynamic impedance at various cross sections along the flow path in such a way that the vortices enlarge and contract in diameter as the fire increases and decreases in heat output. To this end, the vortex inducing structure must not totally confine the circumference of the vortex, but must leave an opening on at least one side sufficient to permit the aforementioned expansion. An increase in diameter of adjacent vortices brings about an increased choking effect to the straight flow of gases therebetween, thus serving as a damper to increase aerodynamic impedance as fire intensity increases. The design should preserve a consistency of aerodynamic impedence throughout the flow path of the donor gas. i.e., the sum of the cross-sectional open air areas in the upper reaches of the combustion chamber should approximately equal the cross-sectional area of the flue duct 17, which is smaller than the average chimney flue in cross-section. Moreover the partial barrier formed by the undersurface 18 of the duct 19 must be substantial and has been found to be most effective when the width of the duct approximates ¼ or more of the total width of the flame enclosure. Adherence to these basic parameters has found embodiment in an experimental fireplace including a fire enclosure having a width of 32 inches in the front tapering to a 28 inch width in the rear, a front height of 29 inches, and an 18° slope from front to rear of the enclosure top 2 and of the recipient air duct 19. This unit includes a 4 inch barrier 15 and has a front-to-rear depth of 21 inches at the base, tapering to a 15 inch depth at the top. An optium flue duct opening 17 is 48 square inches, and is preferably symmetrically triangular or polygonal in shape with a major dimension extending to an apex in the rear half of the top 6 (see FIG. 1). Inasmuch as the slant angle of the flame plate 18 serves to direct the major donative gas flow toward the juncture with the partial front wall 11, the one front juncture is the first to form a vortex and is the preferred heat exchange area. Hence, it is desireable to position the flue duct so as to induce the major donative gas flow in the front of the enclosure. A triangle having an 8 inch base positioned approximately 4 inches behind the forward edge of top 6, and said major dimension of 12 inches maintains a 48 square inch cross sectional area and positions the apex near the rear of the top 6. Flue duct openings as large as 64 square inches are feasible, as are variations in cross sectional configurations, such as square, rectangular, trapezoidal, parallegram. In any configuration, however, the major area of the opening should reside in the front half of the top 6 where it is downstream of said one front juncture.

While described in the foregoing specification in the preferred embodiment of a fireplace, the aerothermodynamic heat exchanger of this invention which employs vortical flow patterns to enhance heat transfer between a relatively unconfined donative gas flow path and an isolated recipient gas flow may find numerous other heat exchange applications. Hence, the scope of this invention is not considered to be limited by this specification, but should be construed in accordance with the following claims.

I claim:

1. Means for exchanging heat between a thermally donative gas and heat exchange surfaces, said means including a donative gas flow path defined at least in part by said heat exchange surfaces and further including:

a source of heat donative gas, means including an exhaust passage for inducing flow of said donative gas through said flow path generally toward said exhaust passage, means for initially diverting at least a portion of the total volume of said donative gas flow to a vortex pattern area, structural means only partially defining said vortex area, said structural means comprising additional flow diverting elements comprising at least part of said heat exchange surfaces effective to remove heat and thus increase the density of said gas proximate to said last mentioned surfaces of said flow diverting elements and thus establish a density gradient across said diverted gas stream to a low pressure area spaced from said diverting elements, said flow diverting elements further effective with said pressure gradient to direct said portion of said gas in a reentrant flow direction away from the confinement of said structural means in an open flow toward said flow path, said gas in said reentrant flow direction being pulled toward said initially diverted gas flow and being further diverted by the induced gas flow to complete a circumferential flow pattern around a low pressure central axis, said pattern being free to expand and contract in said open flow path in accordance with the velocity thereof, and means establishing communication with said exhaust passage for drawing gas axially from said vortex pattern area to maintain a stable vortical flow within said area and in proximity to said heat exchange surfaces, whereby the path of said donative gas and the time of residency of said donative gas in proximity to said surfaces are prolonged throughout varying temperature and velocity conditions thereby to enhance heat exchange therewith.

2. Heat exchange means as recited in claim 1 wherein said source of heated gas is a fire and said vortical pattern is within the area of flame propagation.

3. Heat exchange means as recited in claim 1 wherein said means for diverting said flow include said exchange surface.

4. Heat exchange means as recited in claim 1 wherein said means for diverting a portion of said flow of said donative gas comprises a partial barrier comprising a flame plate disposed transversely across a portion of said flow path and joining said directing means at opposite ends to form junctures which define a position of said vortical pattern having an axis extending laterally of said induced flow.

5. Heat exchange means as recited in claim 4 wherein said flame plate includes at least a portion thereof slanted at an angle in the direction of donative gas flow toward one said juncture to divert said gas toward said one juncture.

6. Heat exchange means as recited in claim 5 wherein said flame plate includes a free edge spaced from a contiguous portion of one heat exchange surface to define a portion of said donative gas flow path therebetween, said flame plate being pitched in the direction of gas flow toward said free edge.

7. Heat exchange means as set forth in claim 6 wherein the ratio of said slant angle to said pitch is substantially within the range of 0.5 to 2.

8. Heat exchange means as set forth in claim 6 wherein said pitch is substantially 15°.

9. Heat exchange mens as set forth in claim 8 wherein said flame plate comprises an elongate member extending across a central portion of said enclosure to present two free edges defining with respective contiguous portions of said enclosure a pair of donative gas flow paths, one either side of said flame plate, and wherein said pitch diverges from a longitudinal center portion in each lateral direction toward the respective free edges.

10. Heat exchange means as set forth in claim 6 wherein said flame plate comprises an elongate member extending across a central portion of said enclosure to present two free edges defining with respective contiguous portions a pair of donative gas flow paths, one either side of said flame plate, and wherein said pitch diverges from a longitudinally center portion in each lateral direction toward the respective free edges.

11. Heat exchange means as set forth in claim 10 wherein the width of said elongate flame plate is at least ¼ the width of said enclosure.

12. Heat exchange means as set forth in claim 5 wherein said exhaust passage has its major area disposed downstream of said one juncture.

13. Heat exchange means as set forth in claim 12 wherein said exhaust passage is substantially triangular in cross-sectional configuration, the base of said triangular configuration constituting said major area and the apex extending away from said base away from said one juncture toward the other of said junctures downstream thereof.

14. Heat exchange means as recited in claim 4 wherein said means defining a donative gas flow is an enclosure and said flame plate includes a free edge spaced from a contiguous portion of said enclosure wall to define a portion of said donative gas flow path therebetween, said flame plate being pitched in the direction of gas flow toward said free edge whereby the axis of said vortical pattern is pitched in the direction of gas flow and terminated beyond said free edge.

15. Heat exchange means as set forth in claim 14 wherein said flame plate comprises an elongate member extending across a central portion of said enclosure to present two free edges defining with said continguous portions a pair of donative gas flow paths, one either side of said flame plate, and wherein said pitch diverges from a longitudinal center portion in each lateral direction toward the respective free edges.

16. Heat exchange means as set forth in claim 15 wherein the width of said elongate flame plate is at least ¼ the width of said enclosure.

17. Heat exchange means as set forth in claim 15, said flame plate including lateral fins projecting toward said source of heated donative gas and being spaced from and substantially parallel to said junctures, said fins coacting with said flame plate surface to define additional diverting means effective to establish additional vorticity patterns of donative gas flow.

18. Heat exchange means as set forth in claim 14 wherein the cross-sectional area of said portion of said donative gas flow defined by said free edge and said contiguous enclosure wall portion bears a substantially equal relationship to the cross-sectional area of said exhaust passage.

19. Heat exchange means as set forth in claim 4 wherein said flame plate comprises a heat exchange surface of a duct, said duct enclosing a flow path of recipient gas.

20. Heat exchange means as set forth in claim 19 wherein said flame plate comprises an elongate member extending across a central portion of said heat exchange surfaces to present two free edges defining with respective contiguous portions of said heat exchange surfaces a pair of donative gas flow paths, one either side of said flame plate, and wherein said pitch diverges from a longitudinal center portion in each lateral direction toward the respective free edges.

21. Heat exchange means as set forth in claim 20 wherein the width of said elongate flame plate is at least ¼ the width of said enclosure.

22. Heat exchange means as recited in claim 4, said flame plate including lateral fins projecting toward said source of heated donative gas and being spaced from and substantially parallel to said junctures, said fins coacting with said flame plate surface to define additional means effective to establish additional vorticity patterns of donative gas flow.

* * * * *